US006318878B1

(12) United States Patent
Dorfman

(10) Patent No.: US 6,318,878 B1
(45) Date of Patent: Nov. 20, 2001

(54) PORTABLE LAMP WITH CONFORMABLE BASE

(76) Inventor: Jerold W. Dorfman, 27 Indianhill, New Rochelle, NY (US) 10804

( * ) Notice: Subject to any disclaimer, the term of this patent is extended or adjusted under 35 U.S.C. 154(b) by 0 days.

(21) Appl. No.: 09/282,167

(22) Filed: Mar. 31, 1999

(51) Int. Cl.[7] ..... F21L 7/00
(52) U.S. Cl. ..... 362/189; 362/183; 362/198
(58) Field of Search ..... 362/98, 183, 184, 362/140, 148

(56) References Cited

U.S. PATENT DOCUMENTS 4,700,634 * 10/1987 Mills et al. ..... 362/98
5,018,057 * 5/1991 Brown ..... 362/800
5,267,130 * 11/1993 Maglica et al. ..... 362/183
5,400,230 * 3/1995 Nicoletti ..... 362/189
5,463,539 * 10/1995 Vandenbelt et al. ..... 362/189
5,475,574 * 12/1995 Chien ..... 362/189
5,921,664 * 7/1999 Lee ..... 362/190
5,927,846 * 7/1999 Sinclair ..... 362/189
5,947,581 * 9/1999 Schrimmer et al. ..... 362/189
6,109,761 * 8/2000 Smith et al. ..... 362/189

* cited by examiner

*Primary Examiner*—Sandra O'Shea
*Assistant Examiner*—Peggy Neils
(74) *Attorney, Agent, or Firm*—Miles & Stockbridge P.C.; Edward J. Kondracki

(57) ABSTRACT

A portable reading lamp having an attached conformable base is provided. The conformable base comprises a sealed bag of granular displaceable material which enables the lamp to be easily mounted on most surfaces, including the user's body, by conforming to the profile of the underlying surface. The conformable bag is arranged to receive and releaseably retain an attached lamp assembly operably embedded into the displaceable material and adjusted in such a way that the light beam produced by the lamp is acceptably stable and has a sufficiently narrow span of illumination to achieve an acceptable level of illumination while being restricted to the reading material.

14 Claims, 6 Drawing Sheets

PORTABLE LAMP WITH CONFORMABLE BASE

BACKGROUND OF THE INVENTION

The present invention relates to a portable lamp and more particularly to a portable reading lamp which can be supported on a conveniently available surface, for example a user's body, so that the light can be directed upon an object such as a book, for example, while the lamp remains in a stable position.

Portable lamps to be attached to a user have been proposed. For example, U.S. Pat. No. 1,319,997 discloses a commonplace flashlight arranged for attachment to apparel, such as a cap, to assist in repair of vehicles. Portable reading lamps are known which can be attached to furniture (U.S. Pat. No. DES. 293,029), reading material (U.S. Pat. No. 4,432,042), or to a lap-positioned portable desk (U.S. Pat. No. 4,700,634). One problem that exists in connection with the use of such portable reading lamps is that they are poor solutions to the need for exclusively illuminating reading material without diminishing the comfort of the user, or disturbing other occupants of the darkened space. An example of such circumstances is use of a portable reading lamp while the user is in bed or resting on a chair. Another problem is that portable reading lights frequently utilize pivoted extensions which can present a hazard to the user should he/she fall asleep. Such extensions also suffer from the disadvantage that they can catch on delicate fabrics. Further extensions increase the cost of manufacture of the reading lamp.

A portable reading lamp for illuminating only the reading material should be simple and economical to manufacture and avoid extensions that can catch on material or poke out an eye. Such lamps should be capable of being directed toward the material being read, while at the same time, not being in the line-of-sight of any occupant of the space, or inadvertently being re-directed in that direction. For convenience, the lamp should be within easy reach of the user and be relatively close to the reading material. The lamp should be easily adjustable or positionable, while at the same time, the pattern of illumination should be insensitive to minor movements and capable of easy direction.

U.S. Design Pat. No. DES. 358,984, proposes a lighted bookmark wherein a miniature arrangement develops a relatively low-power illumination and uses a small battery. Other techniques relying on the reading material for support have also been used. For example, the aforenoted U.S. Pat. No. 4,432,042, directed to a book-light supported by the pages or cover of a book, offers a lamp attached to an adjustable linkage that is clamped to the book, the lamp being powered by a small battery or a transformer-rectifier connected to household electricity. In these proposed designs, the light will move with the reading material, and consequently, such movement may disturb adjacent occupants of the space. In addition, the added weight of the lamp apparatus is cantilevered to some extent outwardly from the book, depending on design and individual adjustment, thereby causing fatigue to the user, when holding book and lamp in position. It is not uncommon for people to fall asleep while reading. Thus, the tubular post or connecting arm could present a danger should the person fall into it.

U.S. Pat. No. 4,700,643 discloses a reading lamp mounted to a lap-positioned desk. The lamp is attached to an articulatable arm, which is attached to a rigid work surface having a cushioned portion underneath. The cushioned portion provides comfort by separating the work surface from the body of the user, and by presenting a resilient surface in contact with the user's body. The cushioned portion has a fixed profile, for example, a tapered profile which provides a slanted work surface and the articulatable arm extends upward in front of the user.

Each of these approaches offer varying degrees of personal illumination to the user. Major factors effecting the ability to provide maximum personal illumination while minimizing disturbance to other individuals include the design of the reflector, lens, lamp, the stability and adjustability of the lamp-mounting arrangement, and the stability of the object on which the lamp is mounted or attached. These factors also determine the useful distance between lamp and illuminated object, but, as with many articles of manufacture, the more sophisticated the design, the greater the cost of manufacture.

The problem to be solved is to provide, at a commercially viable cost and design, a reading lamp which is easily mounted on most surfaces, including the user's body, relatively safe to use, and adjustable in such a way that the light beam is acceptably stable and has a sufficiently narrow span of illumination to achieve an acceptable level of illumination, while being restricted to the reading material.

SUMMARY OF THE INVENTION

The present invention is directed to a portable reading lamp which can be readily supported by a convenient surface, including a user's body, to provide a reading lamp that is relatively stable, and which is easily adjustable. The reading lamp is capable of maintaining a sufficiently narrow beam of light for illuminating only the reading material, while being disposed at a comfortable and unobtrusive position such as, for example, the user's lap, chest, or shoulder, while avoiding disturbance of nearby individuals resulting from broadly visible light.

In accordance with the present invention, there is provided a reading lamp having a housing a lamp assembly disposed in a wall thereof, and an attached, sealed bag of loose, granular material which is easily conformable to the major contour of an underlying surface on which the reading lamp is arranged to rest.

The housing of the present invention includes provision for user-access to batteries mounted therein, a lamp assembly arranged to direct a light beam generally toward the reading material to be illuminated when the lamp is operably positioned, a power switch accessible by the user for connection to one of alternative sources of power. The lamp assembly includes a reflector, lens and bulb arranged so that the user can access and replace the bulb. In one embodiment of the invention, the housing includes provision for capture and retention of the perimeter of the conformable bag assembly.

The power supply provides electrical power to the bulb through an on-off power switch alternatively by at least one battery, or through a jack for receiving a plug connected to a transformer-rectifier arranged for connection too household electricity.

The subject invention is extremely simple in construction and operation. To this end, the conformable bag assembly includes a sealed bag made of flexible material containing displaceable granular material arranged to partially fill the volume of the bag. The displaceable material is arranged to interact with the general profile of the surface beneath the conformable bag assembly, so as to cause the bag to generally conform to the surface profile. The conformable bag assembly is arranged to receive and releaseably retain the housing when a user presses the housing into the displaceable material. The housing thus embedded in the displaceable granular material, attains a desired orientation relative to the underlying surface and tends to remain in place. The desired orientation is determined by adjustment of the light beam emanating from the reading lamp toward the material to be illuminated. For example, while the user is seated in bed (or in a vehicle) and holds the reading material with one hand, the other hand is used to press the portable reading lamp against the user's chest (or lap) so that the conformable bag conforms to the user's body profile. At the same time, the user presses the housing into the displaceable material so that the housing becomes embedded in the material. The user switches the lamp on and adjusts the housing orientation within the displaceable material until the light beam illuminates the reading material. Both the conformable bag assembly and the housing tend to remain in the selected orientation because the displaceable material has been selected to have a specified degree of resistance to flow.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

DETAILED DESCRIPTION OF THE PREFERRED EMBODIMENT

Figure 1:
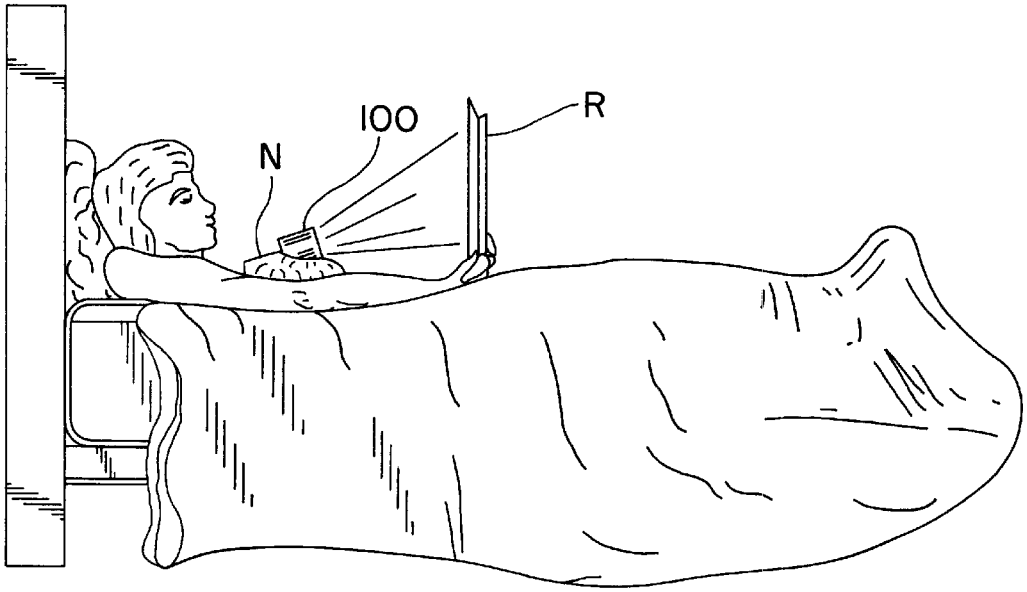
FIG. 1 is a pictorial illustration of a preferred embodiment of the portable reading lamp in use according to the present invention.

Referring initially to FIG. 1, a portable reading lamp assembly 100 is illustrated in one example of use, i.e. reading in bed. Lamp assembly 100 is arranged to generally conform to the profile of the underlying surface, here shown as the upper chest. Lamp assembly 100 also is arranged so that once set, the entire assembly 100 tends to remain in place. In addition, the scope of illumination remains restricted to the reading material R while being relatively insensitive to minor movements of the underlying surface.

Figure 2:
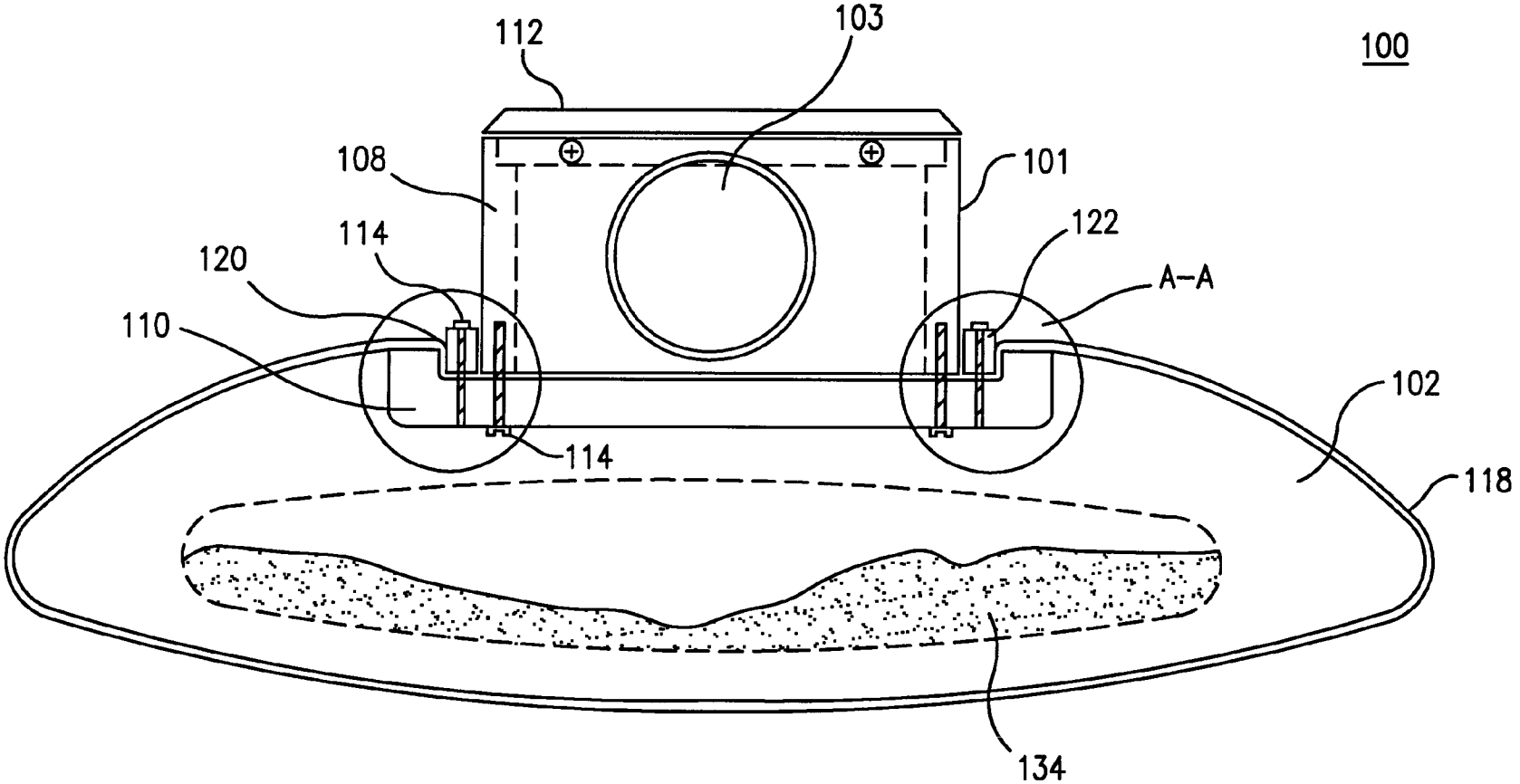
FIG. 2 is a front cross-sectional view of a preferred embodiment of the portable reading lamp, including a cutaway view of the displaceable material, according to the present invention.

FIG. 2 is a front cross-sectional view showing assembly 100 as including housing assembly 101, a conformable bag assembly 102, and a lamp assembly 103. Also included in housing assembly 101 is a power assembly 104, shown in FIG. 5. Housing assembly 101 includes a wall 108, base 110, and lid 112. Wall 108 preferably is cylindrical and base 110 and lid 112 preferably are flat, although each can be arranged to have any shape such that housing assembly 101 is suitable for containing components and has a desired degree of aesthetic appeal. Housing assembly 101 is made of any suitable, preferably lightweight, material, for example, metal, such as aluminum, or plastic, such as polystyrene. Wall 108 and base 110 preferably are fabricated to form one unitary piece, although they can be assembled from individual components and attached by any commonly known method, including mechanical fasteners such as threaded screws 114, metal or plastic clips, as well as gluing, bonding or ultrasonic welding. Likewise, any similar fastening method can be used, including threading or interlocking snap-tabs, to attach lid 112 to wall 108. Alternatively, lid 112 is made integral with wall 108, and a replaceable, snap-fit access panel (not shown) is provided for the user to replace battery 116 (shown in FIG. 5) contained within housing assembly 101.

Housing assembly 101 preferably is cylindrically shaped, however other shapes are envisioned, for example, molded representations of real or imaginary characters or things, each suitable for specific market segments. Alternatively, such features are illustrated on the surface of housing assembly 101.

The conformable bag assembly 102 includes a bag wall 118 forming a generally shaped pocket having a single opening with a perimeter 120. Bag wall 118 preferably is made of cloth having suitable properties conducive to effective hygiene, when disposed in connection with a user's body. Preferably, bag wall 118 advantageously is made of material that is both aesthetically pleasing and comfortable when handled by the user. Additionally, other bag shapes are envisioned, for example, shapes taking the form of real or imaginary characters, or portions of such characters in combination with molded likenesses taking the form of housing assembly 101.

Figure 3:
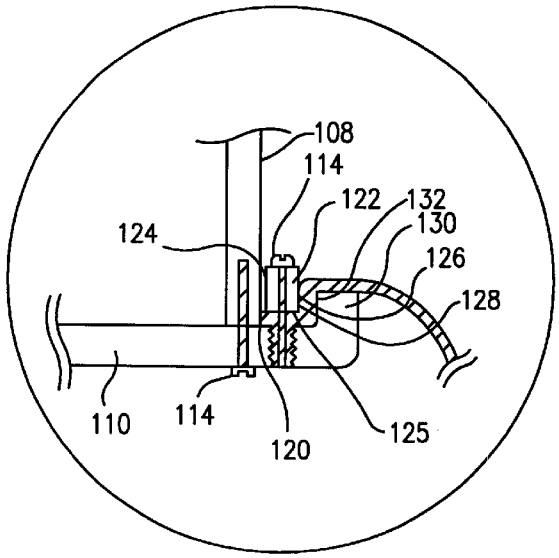
FIG. 3 is a detail view of section A—A of the portable reading lamp illustrated in FIG. 2 according to the present invention.

FIG. 3 is a detail view of section A—A shown in FIG. 2. FIG. 3 shows a cross-sectional view of base 110 and a clamping member 122. Also shown is bag wall perimeter 120 retained between clamping member 122 and base 110. Clamping member 122 is an outwardly directed flange, preferably having the form of a continuous ring having an inner diameter 124, an outer diameter 126, and a clamping member bottom surface 125 connecting diameters 124 and 126. Inner diameter 124 is dimensioned to fit adjacent to wall 108 and outer diameter 126 defines an outside wall 128.

Base 110 includes at its periphery an integral outward extending flange 130, which is an upstanding portion of suitable height and having an inside surface 132. Base 110 is arranged to capture and retain bag wall 118 by sealingly clamping the perimeter 120 of bag wall 118 between the inside surface 132 of flange 130 and the outside wall 128 of a clamping member 122.

Clamping member 122 preferably is attached to base 110 by a suitable number of screws 114 arranged around the extent of clamping member 122, the screws penetrating through clamping member 122 and threading into base 110, so as to firmly clamp and retain the bag wall 118 at the bag wall perimeter 120 between base 110 and clamping member bottom surface 125. Clamping member 122 alternatively is arranged in sections. In another embodiment, clamping member 122 is arranged to be in bonded, threaded or snapping engagement with housing assembly 101.

In still another embodiment, conformable bag assembly 102 is completely sealed and attached to an exterior surface of base 110 by any suitable means, for example glue or rivets (not shown).

Returning to FIG. 2, displaceable material 134, shown in a cut-away view, is arranged to fill 30–80% of the volume of conformable bag assembly 102 and preferably fill 40–50% of bag assembly 102. A range of 30–80% is effective, while a preferable range of 40–50% is optimal for providing an effective balance of factors, including the stability of the reading lamp assembly 100 while positioned on an underlying surface contour, the ease of adjusting the orientation of housing assembly 101 while embedding the assembly 101 in the displaceable material 134, and the extent to which the assembly 101 remains relatively immobile once embedded. Displaceable material 134 preferably is dry and granular and has a shape conducive to resisting flow. It has been found that non-spherical shaped grains have a tendency to flow less freely than generally spherical grains. For example, rice has been shown to have less rolling friction than spherical shaped grains of similar surface texture. Alternatively, the displaceable material is other asymmetric, or otherwise non-spherical grains. In another alternative embodiment, the displaceable material generally has a faceted, cratered, or textured surface. In the preferred embodiment, rice, suitably dried, performs very well as displaceable material 134, when included in the portable reading lamp assembly 100. It is found that the shape of the rice grains provides a suitable amount of resistance to flow, which is essential for anchoring the reading lamp assembly 100 in place, while at the same time, requiring relatively little applied force for embedding housing assembly 101 among the individual rice grains. While rice has been described as a preferred material, any inert chip or micro chip may be utilized which preferably does not readily break up into fine particles or deteriorate with time. For example, materials such as plastic pellets or flakes, dry beans, shot, cementation aggregates, gravel and other asymmetric materials may be used instead of or mixed with rice.

Figure 4:
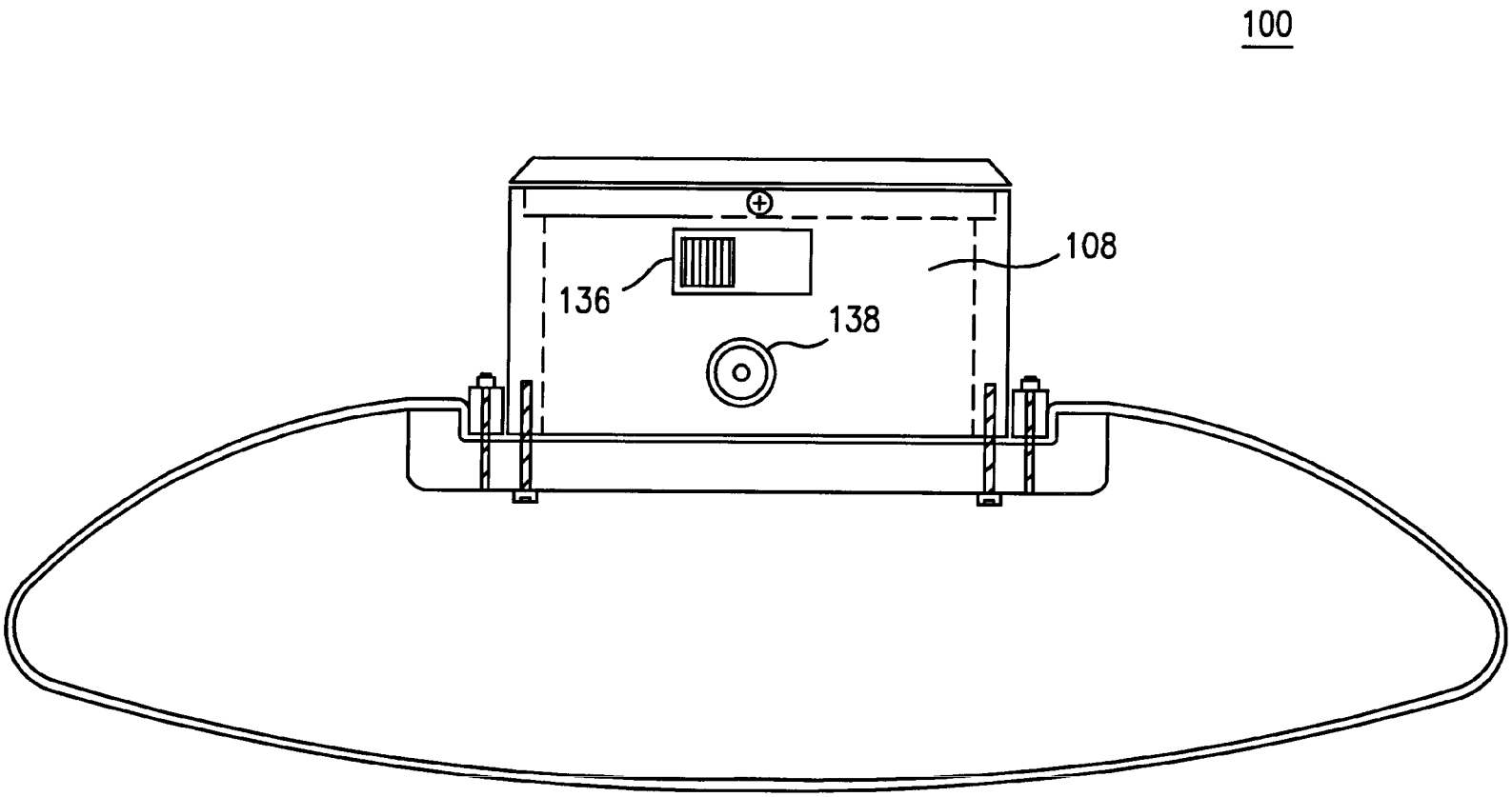
FIG. 4 is a rear sectional view of the portable reading lamp illustrated in FIG. 2 according to the present invention.

FIG. 4 is a rear cross-sectional view of portable reading lamp assembly 100. Housing assembly 101 includes a power switch 136 and a jack 138, both mounted therein and generally arranged to operatively protrude through the outer surface of wall 108.

Figure 5:
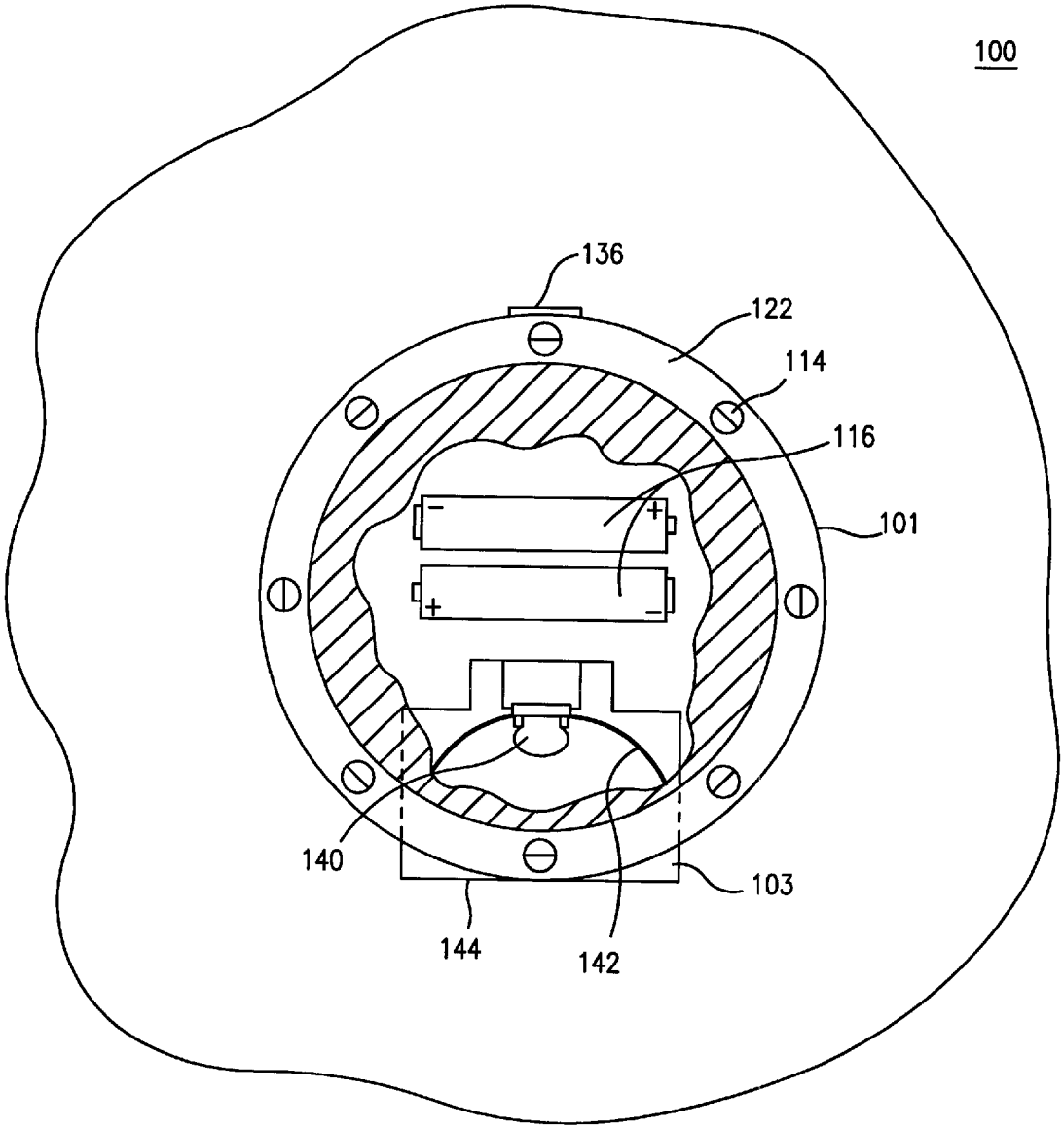
FIG. 5 is top view of the portable reading lamp illustrated in FIG. 2 according to the present invention.

FIG. 5 is a top view, including a cut-away view of battery 116 and lamp assembly 103 in housing assembly 101. Lamp assembly 103 includes a reflector 142 and lens 144 selected to restrict the scope of illumination to include only a region generally close to the reading material, according to generally known principles known to those skilled in the art. The selection takes into account distances between reading lamp assembly 100 and the reading material, as encountered by the typical user. Lamp assembly 103 preferably is arranged to permit user access to the bulb 140 housed therein, by commonly known methods. Alternatively, lamp assembly 103 is arranged to permanently house bulb 140. Bulb 140 alternatively is any suitable light emitting element.

Also shown is the general arrangement of one embodiment of the invention, in which the conformable bag assembly 102 is attached to the housing assembly 101 by screws 114 and clamping member 122 in the form of a continuous, circular ring.

Figure 6:
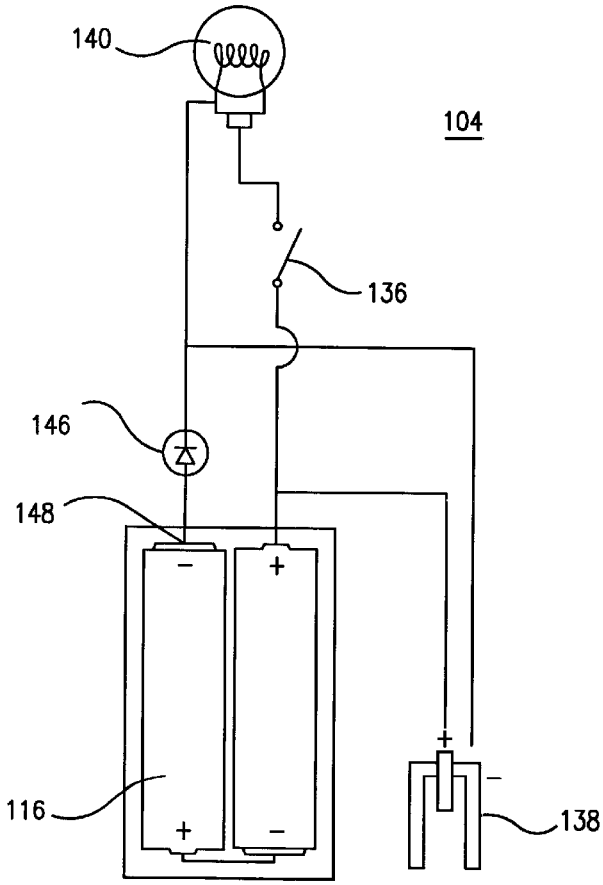
FIG. 6 is a schematic diagram of the electrical circuit of the portable reading lamp illustrated in FIG. 2 according to the present invention.

FIG. 6 is a schematic diagram of the electrical circuit of the power supply 104. Battery 116 provides a portable source of power from any suitable size and number of batteries. In the preferred embodiment, battery 116 takes the form of two one and one half volt "AA" batteries. Batteries 116 are electrically connected in series with a diode 146 such that the anode side of the diode 146 is connected to the negative battery terminal 148, bulb 140, and a power switch 136, thereby forming a complete electrical circuit. Diode 146 is selected to provide protection to battery 116, when external power is connected in parallel with battery 116.

Jack 138 is connected in parallel with the positive terminal of the battery and the cathode side of the diode 146. Jack 138 is arranged to receive a plug (not shown) connected to any suitable transformer-rectifier (not shown), which is arranged for connection to household voltage and outputting sufficient current at an appropriate voltage, for example, 1.5/3 volts, D.C at 300 mA. The transformer-rectifier and plug assembly is a commonly available commercial item, for example, Radio Shack® AC adapter catalog number 273-1654B, and does not form an inventive part of the disclosure. In one embodiment, the commercially available transformer-rectifier has dual operating voltages, for example, 1.5/3.0 volts, and a switch operably disposed on the transformer-rectifier for the user to select among the available voltage options, which provide a choice of relatively bright or dim illumination.

Figure 7:
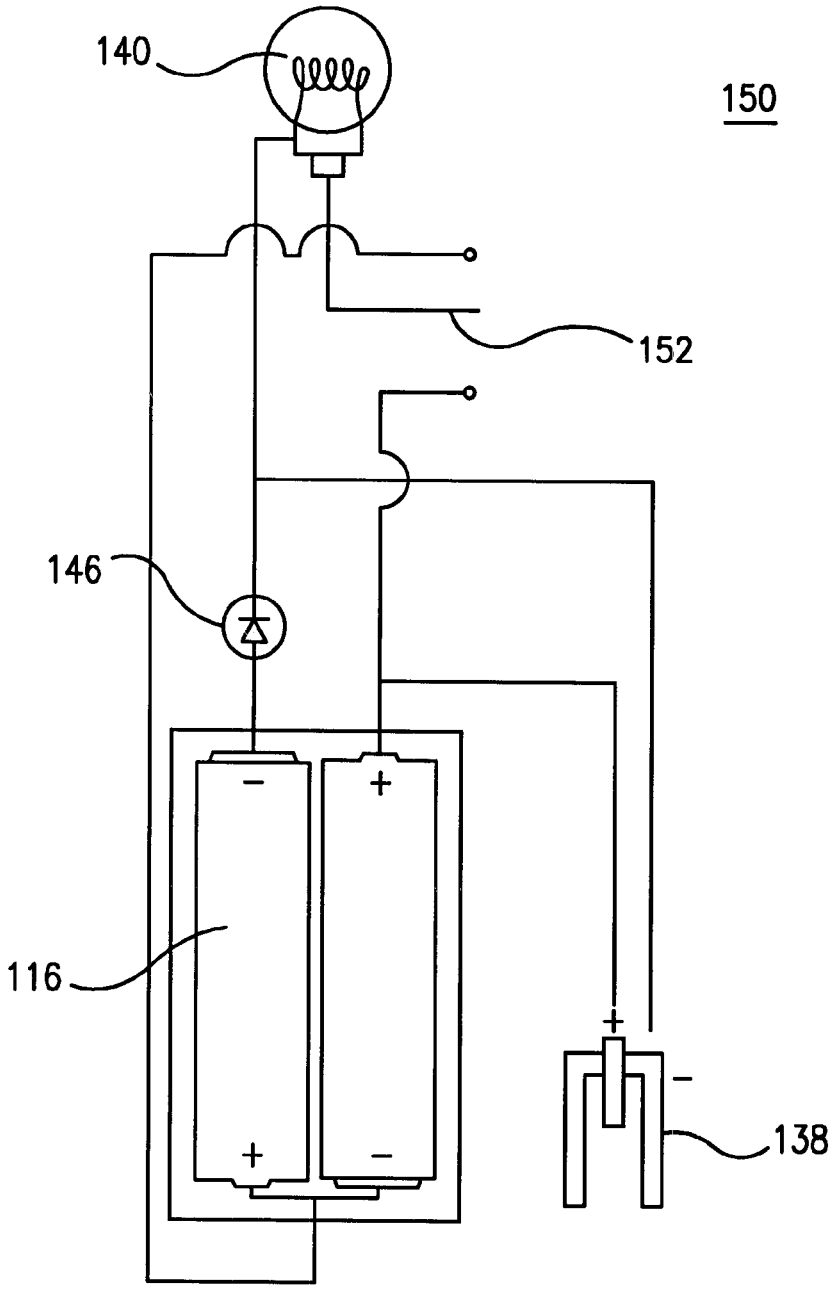
FIG. 7 is a schematic diagram of an alternative embodiment of the electrical circuit illustrated in FIG. 6.

FIG. 7 is a schematic diagram of the electrical circuit of an alternative power supply 150 for use with reading lamp assembly 100, which includes any suitable circuit that provides a selectable option of two voltage levels to bulb 140. For example, a three-way switch 152 having operative on-off-on positions and battery 116 having a set of two 1.5 volt batteries are electrically connected so that in a first switch position, switch 152 connects the batteries 116 in series, thereby providing 3.0 volts to bulb 140, and consequently providing a relatively bright illumination. Alternatively, in a second switch position, switch 152 connects one of the batteries 116, thereby providing 1.5 volts to bulb 140, which produces a less bright illumination. Other arrangements are envisioned which are connected to provide selectable levels of illumination.

It is to be recognized that the foregoing preferred embodiments are depicted and described for illustrative purposes, and the invention is not to be limited only to such embodiments. Various modifications and changes may become apparent to these of ordinary skill in the art upon studying this disclosure, and such modifications and changes do not depart from the spirit and scope of the invention. Accordingly, the scope of the invention herein is to be determined by reference to the appended claims.

What is claimed is:

1. A portable reading lamp comprising:

a lamp assembly;

a housing assembly containing said lamp assembly and having a base;

a depending conformable bag having a peripheral opening releasably attached to the base of said housing assembly;

said conformable bag containing loose and freely displaceable granular material of a quantity sufficient to adjustably retain the lamp assembly in any of a plurality of seated orientations on the displaced granular material, said quantity also being sufficient to permit adjustment of the lamp assembly from a first seated orientation to a second seated orientation without repositioning the conformable bag.

2. The portable reading lamp recited in claim 1, wherein said bag is a sealed hollow bag containing a quantity of displaceable granular material occupying 30–80% of the total volume of the bag.

3. The portable reading lamp recited in claim 2, wherein the displaceable granular material occupying 40–50% of the total volume of the bag.

4. The portable reading lamp recited in claim 2, wherein the displaceable material is rice.

5. The portable reading lamp recited in claim 1, further comprising:

a clamping member mounted to the housing assembly, establishing a plurality of points of attachment for the bag and wherein at every point of attachment of the conformable bag assembly is clamped between said clamping member and said housing assembly.

6. The portable reading lamp recited in claim 4, wherein the conformable bag assembly includes a bag having a single opening and the clamping member is a flange arranged to clamp a perimeter of said opening to said housing assembly.

7. The portable reading lamp recited in claim 1, wherein the housing assembly has an interior and further comprises:

a power supply disposed within the interior, the power supply being electrically connected to the lamp assembly for supplying electric power to said lamp assembly.

8. The portable reading lamp recited in claim 7, wherein the power supply provides more than one value of voltage, each value of voltage causing said lamp assembly to produce a corresponding different level of illumination.

9. The portable reading lamp recited in claim 7, wherein the power supply includes at least one battery for supplying electric power to said lamp assembly.

10. The portable reading lamp recited in claim 7, wherein the power supply includes an electrical attachment to an external source of electric power.

11. The portable reading lamp recited in claim 9, further including a one-way current limiting device electrically connected to said at least one battery for protecting said battery while the power supply is electrically connected to said external source of electric power.

12. The portable reading lamp of claim 9, wherein the one-way current limiting device is a diode.

13. The portable reading lamp in claim 2, wherein said displaceable material is rice.

14. The portable reading lamp recited in claim 1, wherein said second seated orientation is an upwardly tilted orientation.

* * * * *